United States Patent [19]

Gruber

[11] 4,128,190

[45] Dec. 5, 1978

[54] POST MIX SOFT DRINK DISPENSER

[76] Inventor: Vincent A. Gruber, 515 E. Washington St., Rochester, Pa. 15074

[21] Appl. No.: 796,542

[22] Filed: May 13, 1977

[51] Int. Cl.[2] ..... B67D 5/56

[52] U.S. Cl. ..... 222/129.2; 137/607; 222/145

[58] Field of Search ..... 222/129.1, 129.2, 129.3, 222/129.4, 135, 145; 137/607; 141/105, 302, 362

[56] References Cited

U.S. PATENT DOCUMENTS

| | | | |
|---|---|---|---|
| 2,495,210 | 1/1950 | Copping | 137/266 X |
| 3,163,177 | 12/1964 | Welty et al. | 137/607 |
| 3,640,433 | 2/1972 | Rodth | 222/129.4 X |
| 3,799,402 | 3/1974 | Meister | 222/129.2 |
| 3,800,826 | 4/1974 | McCann | 222/129.1 X |

*Primary Examiner*—Stanley H. Tollberg
*Assistant Examiner*—Fred A. Silverberg
*Attorney, Agent, or Firm*—Edward E. Roberts

[57] ABSTRACT

There is provided a post-mix drink dispenser of a novel design which permits higher carbonation and faster flow of materials than the existing dispensers. The dispenser includes a pressure equalizing nozzle for dispensing carbonated water, and a suitable syrup distributor. The syrup and carbonated water are permitted to mix when a first stem valve is moved to a prescribed position. The first stem valve is moved in conjunction with a flexible diaphragm. The diaphragm is maintained in a first position by a pressure differential of carbonated water pressure on opposite sides thereof such that no mixing or dispensing occurs. The diaphragm flexes to a second position when the carbonated water achieves different pressure states on opposite side of the diaphragm. The different pressure states are controlled by a second stem valve. The second stem valve controls the states of a pressure bleed path as a function of the position of a mechanical lever means which is operated by the user of the dispenser.

15 Claims, 8 Drawing Figures

FIG. 1.
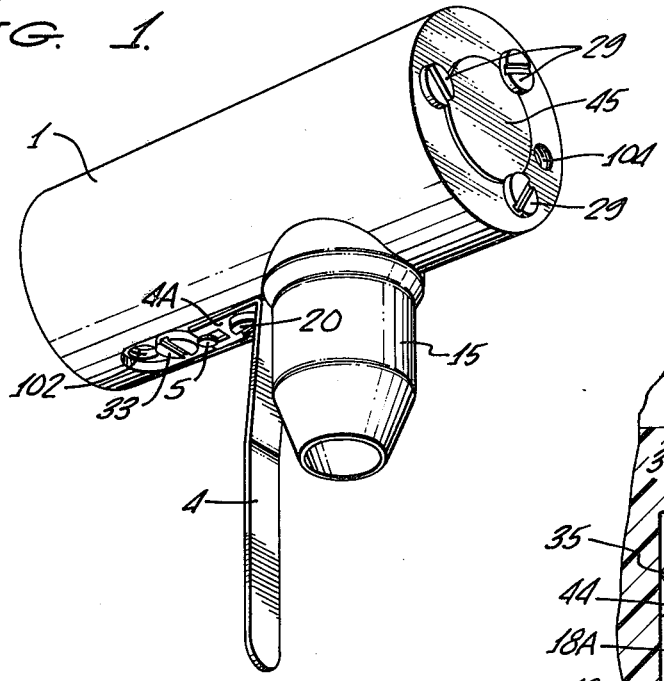
FIG. 4.
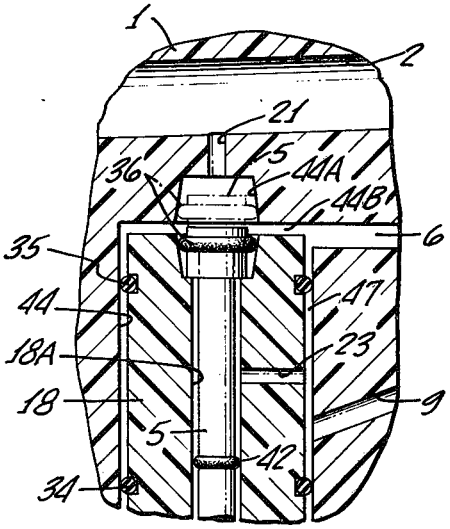
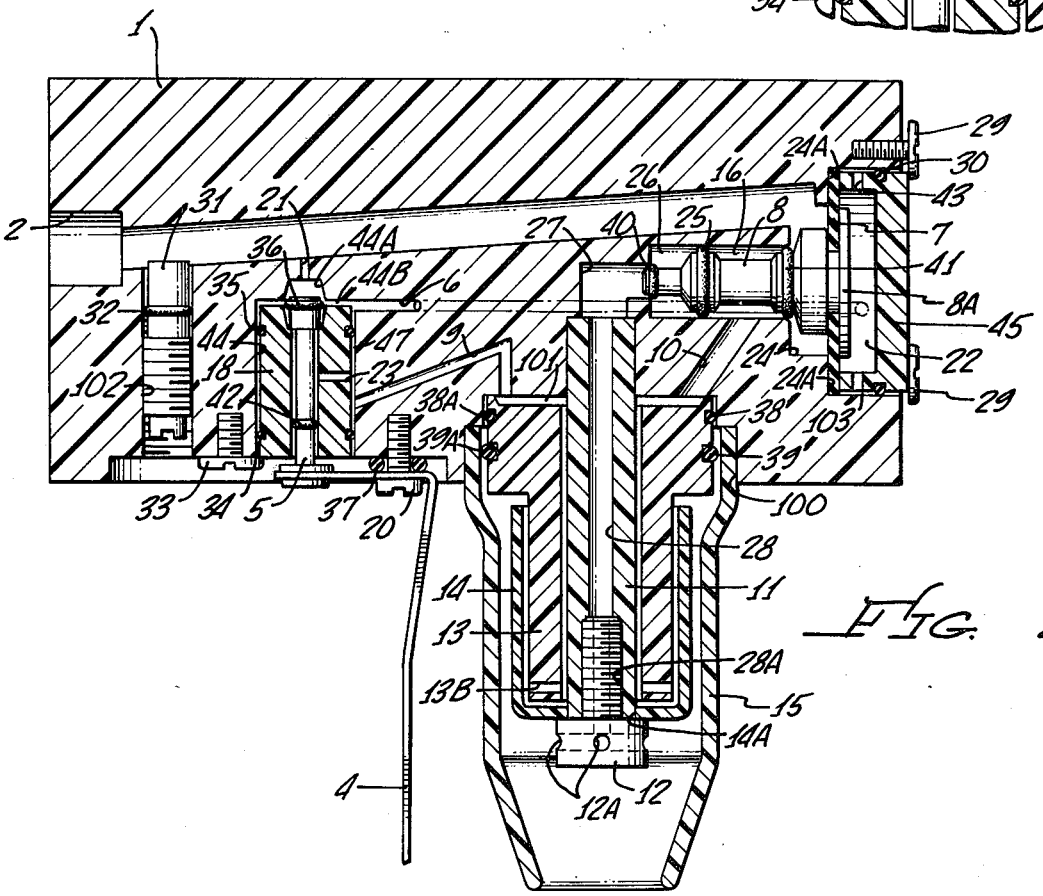
FIG. 2.

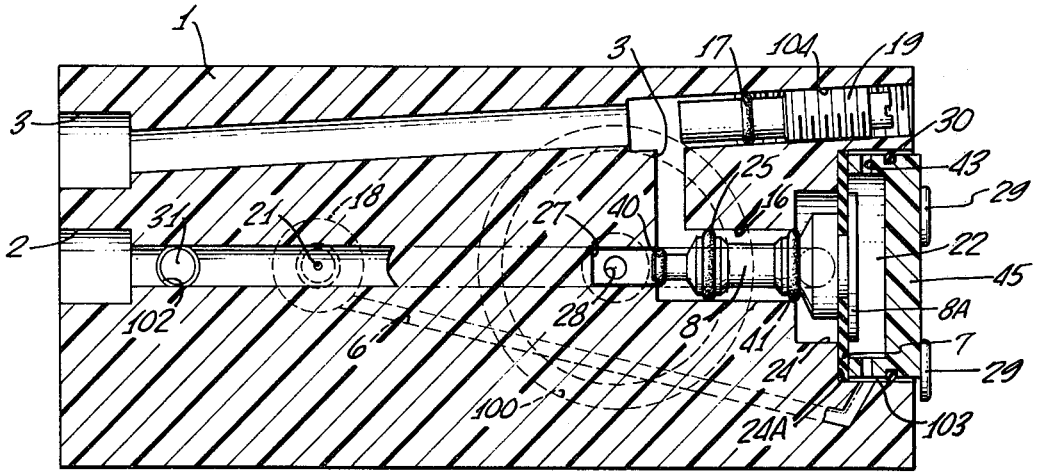
FIG. 3.
FIG. 5A.
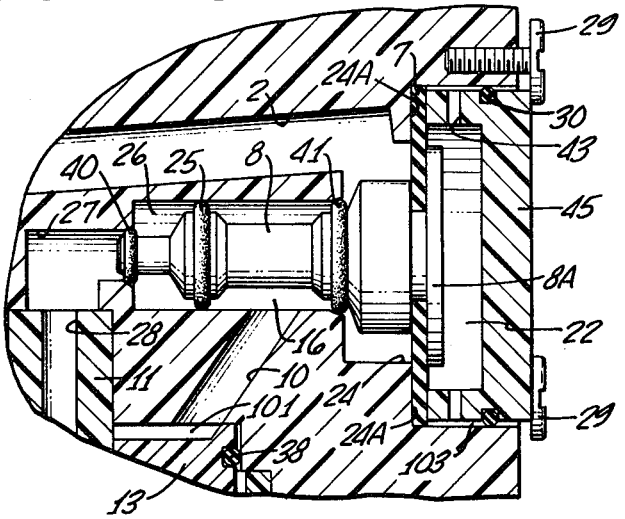
FIG. 5B.
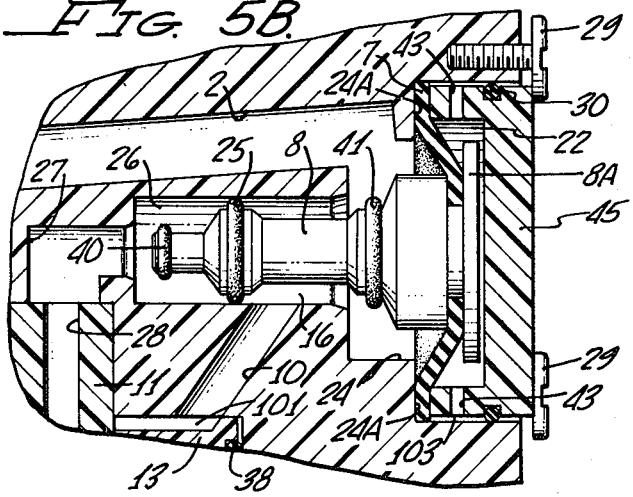
FIG. 6.
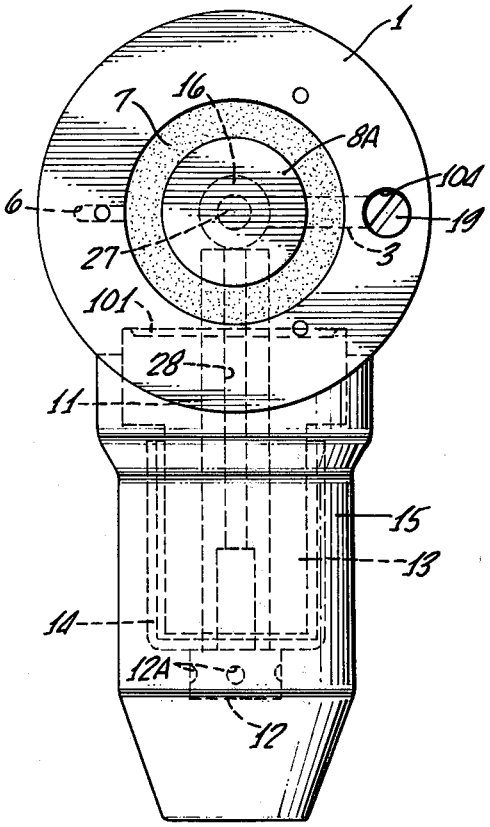

POST MIX SOFT DRINK DISPENSER

BACKGROUND

1. Field of the Invention

This invention is directed towards proportioning and mixing devices in general, and to an improved apparatus for producing accurately proportioned fluid mixtures, in particular. Furthermore, and with greater particularity, the invention is directed towards a liquid dispenser, of the post-mix drink dispensing type.

2. Prior Art

There are many known dispensers in the prior art. These dispensers and valves are utilized for mixing, dispensing and proportioning syrup and carbonated water, among other materials. However, most of the known dispensers are complicated mechanical, electrical or hydraulic devices having many moving parts. Obviously, with many moving parts maintenance and upkeep become significant problems. Moreover, the tolerances involved relative to the several parts are important and can become critical with age and wear of the apparatus.

A review of the art has indicated that the devices best known in the art include extemely complicated structures having many parts which are interrelated and many of which are moving parts. The inherent problems associated with such devices is readily apparent to those skilled in the art.

SUMMARY OF THE INVENTION

The beverage dispenser of the instant invention provides an apparatus for closely proportioning at least two kinds of liquid, such as carbonated water and a syrup. The liquids flow simultaneously and are mixed when a prescribed pressure condition exists relative to a flexible diaphragm on a valve stem. With movement of the diaphragm, the valve stem also moves and simultaneously permits mixing of the two liquids. The pressure conditions related to the flexible diaphragm are controlled by a pressure bleed path which is established via a further valve which is controlled by an operator actuated lever.

Metering means are provided to control the amount of liquid (or fluid) of each kind in order to control the dispensing speed as well as the mixture content of the drink.

BRIEF DESCRIPTION OF THE DRAWINGS

FIG. 1 is a perspective view of the invention

FIG. 2 is a side view, partially in section, of the invention.

FIG. 3 is a top view, partially in section, of the invention.

FIG. 4 is a detailed showing of a valve stem shown in FIG. 2.

FIGS. 5*a* and 5*b* are detailed sections of a further valve stem shown in FIG. 2.

FIG. 6 is a front view, partially in section, of the invention.

DESCRIPTION OF THE PREFERRED EMBODIMENT

Figure 7:
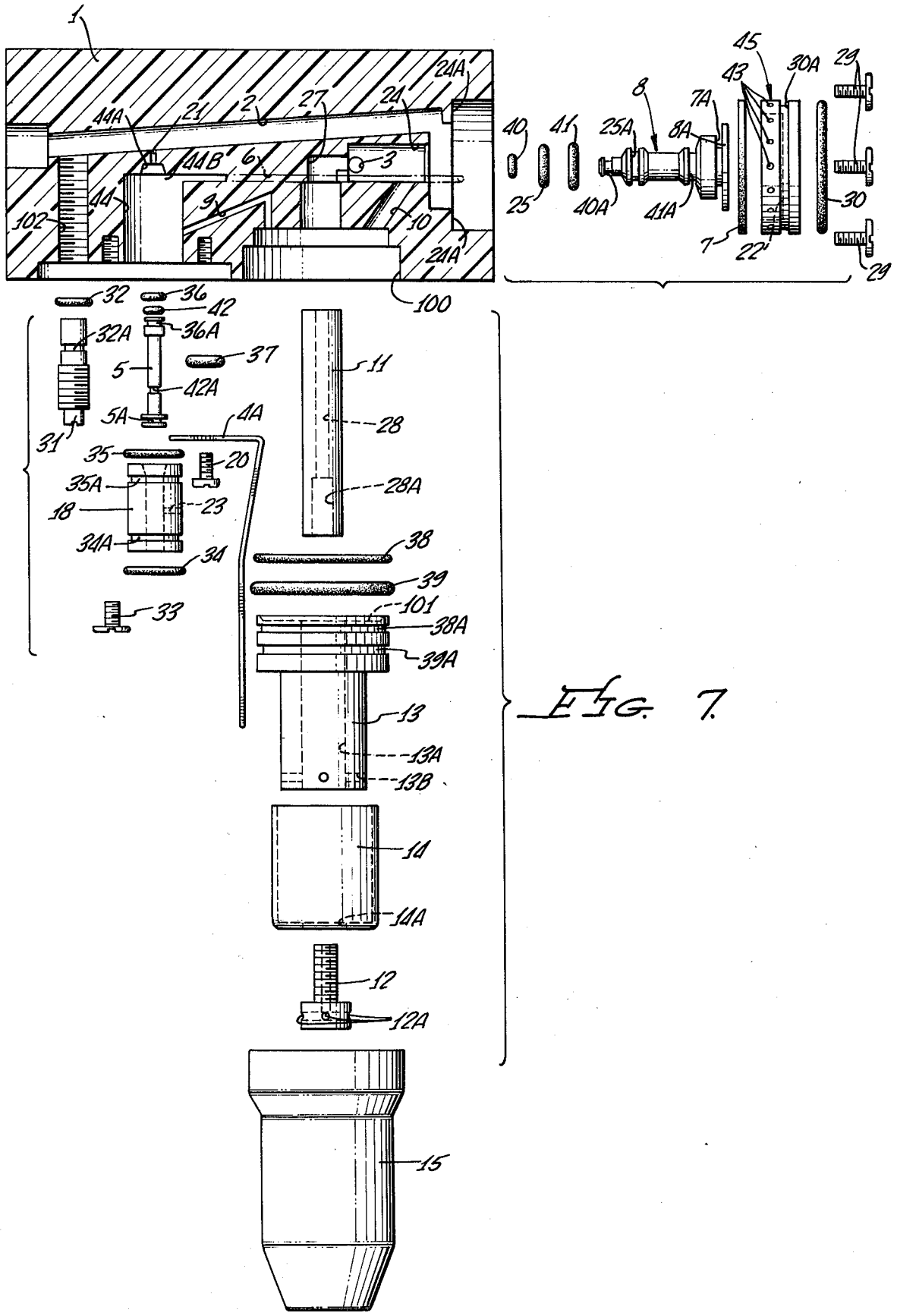
FIG. 7 is an exploded view from the side of the invention taken partially in section and partially in phantom.

Referring now to FIG. 1, there is shown a perspective view of the invention. In the perspective view shown in FIG. 1, the main body 1 has a dispensing nozzle 15 joined thereto. End cap 45 is maintained in place by suitable mounting means such as screws 29. Operating lever 4 is pivotably mounted to body 1 by means of suitable mounting means such as screw 20. Lever 4 engages an end of stem valve 5. Consequently, movement of lever 4, as indicated by the arrow, shown in FIG. 2, causes the pivoting around pivot screw 20, and as a result up and down relative motion of stem valve 5.

In the embodiment shown in FIG. 1, screws 29 or other similar mounting means are utilized to maintain end cap 45 in place. End cap 45 can be replaced by a suitable plate or similar structural element to close the end of body 1 and form a portion of the pressurized system as described herein after.

Concurrent reference is now made to FIGS. 2 and 3. Again, body 1 is shown. The mounting arrangement in the form of screw 20 in this embodiment is passed through the shorter leg of L shaped lever arm 4 and engages an appropriate aperture or hole in body 1. Screw 20 also passes through pivot means such as O-ring 37 in order to provide a flexible pivot mounting means. As noted, lever arm 4 engages the outer end of valve stem 5. In particular, valve stem 5 may include an enlarged outer end portion which is engaged by the shorter arm of lever arm 4. The end of the shorter arm of lever arm 4 may have a bifurcated configuration to span the central portion of valve stem 5 while engaging the enlarged end thereof. The other (inner) end of stem valve 5 is also enlarged. The inner end of stem valve 5 includes a suitable groove for receiving O-ring 36. In addition O-ring 42 encircles the narrow portion of valve stem 5. The O-rings provide fluid tight seals with the related components and define "compartments" or "clearances" through which fluid flow is controlled.

Valve stem 5 is disposed in the central bore of substantially cylindrical housing 18. The central bore of housing 18 has a somewhat enlarged first (inner) end to receive the aforesaid enlarged inner end of valve stem 5. O-ring 36 is arranged to provide a fluid tight seal between valve stem 5 and the inner surface of the bore in housing 18. Housing 18 includes a pair of grooves adjacent the opposite ends thereof for receiving O-rings 34 and 35, respectively. O-rings 34 and 35 provide fluid tight seals between housing 18 and bore 44 formed in valve body 1. Bore 23 is provided through the wall of housing 18 to communicate from the central bore thereof to the space defined by the clearance between bore 44 in valve body 1 and the outer periphery of housing 18. Moreover, bore 23 is disposed between O-rings 34 and 35.

Housing 18 is retained in bore 44 of valve body 1 by means of a suitable mounting device such as screw 33. In particular, screw 33 engages valve body 1 in a suitable manner and the head thereof either directly or through a washer or the like abuts the outer end of housing 18 to maintain housing 18 in bore 44. Even though O-rings 34 and 35 provide fluid tight seals, pressure is applied to housing 18 by liquids, as defined hereinafter. Mounting screw 33 provides secure mounting base for housing 18.

Bore 44 includes an extension therefrom at the inner end thereof which forms cavity 44A. Cavity 44A has a diameter which establishes a fluid tight seal with O-ring 36 when valve stem 5 is moved inwardly by rotation of lever arm 4 as described hereinafter.

Cavity 44A communicates with port 2 via suitable bore 21. Port 2 is arranged to be interconnected to the source of carbonated water (not shown). As more clearly shown in FIGS. 5A and 5B, the other ond of bore 2 communicates with cavity 24 in which valve stem 8 is disposed. Valve stem 8 includes an enlarged end portion 8A adjacent to which there is a groove for receiving flexible diaphragm 7. Diaphragm 7 may be formed of neoprene, rubber or any suitable material. Diaphragm 7 has a larger outer diameter than end 8A of valve stem 8. Diaphragm 7 engages, adjacent the outer ends thereof, shoulder 24A of cavity 24.

The main body portion of valve stem 8 includes an elongated member having grooves therein for receiving O-ring 25 and 41, respectively. The O-rings form a liquid tight seal with the inner surface of an extended bore portion of cavity 24. In addition O-rings 25 and 41 define an area 16 therebetween which is an area between the surface of the bore in cavity 24 and the surface of valve stem 8.

An additional extension at the end of valve stem 8 includes a somewhat diminished outer diameter. In addition, there is provided a groove adjacent the end of valve stem 8 for receiving O-ring 40. O-ring 40 forms a fluid tight seal between valve stem 8 and port 27, which communicates with bore 28. O-rings 25 and 40 define an area 26 therebetween the surface of the bore in cavity 24 and the surface of valve stem 8.

Bore 28 is a central aperture in syrup stem 11. In a preferred embodiment, stem 11 is formed of stainless steel or other suitable material. The other end of stem 11 is threaded at the inner surface of bore 28. Syrup distributor cap 12 includes a threaded portion which engages the threads in bore 28 and further includes a central bore which communicates with bore 28 as well as ports 12 A in distributor cap 12. In addition, cap 12 passes through an aperture in the end of pressure equalizer cup 14. When cap 12 is engaged with stem 11, cup 14 is maintained in position as shown. In addition, soda diffuser 13 includes a central bore for receiving stem 11. The outer end of diffuser 13 is dimensioned so as to fit within pressure equalizer cup 14 and provide clearance therebetween. Moreover, a clearance is provided between a central bore of soda diffuser 13 and the outer dimension of stem 11. At the inner end thereof, diffuser 13 has a somewhat larger dimension as well as grooves for receiving O-rings 38 and 39. O-ring 38 forms a fluid tight seal between diffuser 13 and a bore in valve body 1. On the other hand, O-ring 39 provides a liquid tight seal between diffuser 13 and pouring spout 15. In general, spout 15 is mounted in a suitable bore in valve body 1 and maintained therein through the pressure fit formed by O-ring 39. Of course, additional supporting mechanisms may be provided is so desired.

It should be noted that a clearance (or open area) is provided between the inner end surface of diffuser 13 and the inner surface of bore 100 into which diffuser 13 is placed. This clearance provides a suitable cavity 101 which communicates with cavity 24 and bore 10. In addition, cavity 101 communicates with cavity 47 associated with housing 18 via bore 9.

In addition bore 102 is provided through valve body 1 to communicate with port 2. Bore 102 is threaded in order to threadedly receive metering screw 31. Metering screw 31 substantially completely engages bore 102 and includes a groove for receiving O-ring 32. O-ring 32 provides a fluid tight seal between screw 31 and bore 102 which communicates with bore 2.

Metering screw 31 can be selectively adjusted by appropriate turning wherein screw 31 moves inwardly or outwardly relative to bore 2 to effectively constrict the fluid flow through bore 2, thereby controlling the amount of carbonated water applied through bore 2.

At the other end of valve body 1, cap 45 is maintained in place by suitable mounting screws 29 or the like. Mounting cap 45 includes, on the inner surface thereof, a depression which defines cavity 22 between cap 45 and diaphragm 7 as well as end 8A of valve stem 8. The raised lip or shoulder surrounding cavity 22 and formed on the inner surface of cap 45 includes plurality of ports 43 which communicate from cavity 22 to clearance 103 (FIG. 5A) formed between the periphery of cap 45 and the inner surface at the end of cavity 24. In addition, cap 45 includes a groove for receiving O-ring 30 which is disposed between the outer surface of cap 45 and ports 43 in order to assist in the definition of cavity 103. Bore 6 is interconnected between cavity 22 and bore 44 adjacent to housing 18. The arrangement of bore 6 relative to cavity 22 and bore 44 (the adjacent housing 18) is best shown in FIG. 3.

Also best shown in FIG. 3, is syrup metering screw 19 which is threadedly engaged with bore 104 which communicates with bore 3. Bore 3 is connected to the syrup dispensing source and, also, communicates with cavity 27. Syrup metering screw 19 includes provision for O-ring 17 which establishes a liquid tight seal between screw 19 and bore 3. By properly turning screw 19, bore 3 can be selectively constricted wherein the syrup flow through bore 3 is controlled.

Before describing the operation of the invention, reference is first made to FIGS. 4, 5A and 5B to illustrate details of portions of the invention. FIGS. 4, 5A and 5B are enlarged diagrams which are provided for the purpose of understanding and describing operations of specific portions of the invention.

Referring to FIG. 4 there is shown a detailed and enlarged view of a portion of the inner end of valve stem 5 and housing 18 as related to bore 44 and valve body 1. As shown in FIG. 4 housing 18 includes O-rings 34 and 35 which form liquid tight seals with bore 44 in valve body 1. Likewise, valve stem 5 includes O-ring 36 which moves therewith. As shown in solid line, valve stem 5 is in the down or outer position. In this position O-ring 36 forms a liquid tight seal with the bore in housing 18. Consequently, in this position fluid pressure in bore 2 communicates with bore 6 via bore 21 and a clearance in bore 44. O-ring 35 forms a liquid tight seal which prevents the fluid from flowing through bore 44 around housing 18. O-ring 36 prevents fluid from flowing through the central bore in housing 18.

When valve stem 5 is moved inwardly, or in the up position, by operation of lever arm 4, O-ring 36 (shown dashed) moves upwardly with valve stem 5 (shown dashed) and forms a liquid tight seal with bore extension 44A. With this seal arrangement, bore 2 is effectively cut off from bore 44 as well as bore 6 which communicates therewith. Bore 6 is now able to communicate through bore 44 and clearance 47 and the central bore in housing 18 because O-ring 36 has been moved upwardly and no longer seals bore 18A.

Referring now to FIGS. 5A and 5B there is shown detailed enlarged portions of the invention as related to valve stem 8. As shown in FIG. 5A, valve stem 8 is positioned in the left or innermost position. In this position, diaphragm 7 abuts shoulder 24A of cavity 24. In addition, O-ring 40 clearly seals port 27 and prevents fluid flow therethrough. Similarly, O-rings 41 and 25 create a seal between valve stem 8 and the side of cavity 24 to establish a clearance cavity 16, between valve stem 8, the surface of cavity 24 and O-rings 41 and 25. This condition occurs concurrently with the down or lower position of valve stem 5 as shown in FIG. 4.

Referring now to FIG. 5B it is seen that diaphragm 7 is flexed or bowed inwardly into cavity 22 in cap 45. When diaphragm 7 is bowed, valve stem 8 moves to the right in front of valve body 1. When valve stem 8 moves to the right, or front of body 1, O-ring 40 is removed from the fluid tight seal with port 27 such that this port is now open. In addition, O-ring 41 is removed from the fluid tight seal with the inner surface of cavity 24. However, O-ring 25 remains in the fluid tight sealing arrangement as described supra.

In describing the operation, concurrent references are made to FIGS. 2, 3,4,5A and 5B. Initially it is assumed that the dispenser is in the inoperative non-flowing condition. Thus lever arm 4 is in the off position. In this situation soda pressure through bore 21 holds valve stem 5 in the down position as shown in solid line in FIG. 4. As noted supra, with valve stem 5 in this position, O-ring 36 seals the bore through the center of housing 18. The carbonated water which is supplied to port 2 by a source of known type is applied via port 2 to the inner surface of diaphragm 7. Concurrently, carbonated water pressure is applied through bore 21 and clearance 44B adjacent housing 18 through bore 6 into cavity 22. Consequently, carbonated water is applied to both sides of flexible diaphragm 7 and exerts pressure thereon. Since the front of diaphragm 7 is larger than the back of diaphragm 7, a pressure differential is created causing diaphragm 7 to move to the left. Therefore diaphragm 7 remains in the substantially flat position as suggested in FIG. 5A. Also valve stem 8 is in the left most position as shown in FIG. 5A which provides the fluid tight seals established by O-rings 40, 41 and 25. Consequently, a substantially closed loop is provided for the carbonated water. In addition, as best seen in FIG. 3, O-rings 25 and 40 seals ports 27 and 10 respectively from bore 3 wherein the syrup flow in the dispenser is blocked.

If now lever arm 4 is moved to the left as suggested by the arrow in FIG. 2, lever arm 4 pivots around O-ring 37 as controlled by mounting screw 20. The shorter arm of lever arm 4 engages valve stem 5 and pushes the valve stem upwardly into the position shown by the dashed outline of valve stem 5 in FIG. 4. In this condition O-ring 36 mates with the sides of clearance 44A thereby effectively sealing off bore 21. Thus no carbonated water will then flow through bore 21. At the same time, soda water in area 22 is able to communicate through ports 43 and then through bore 6, through clearance 44B and bore 18A in the center of housing 18. Carbonated water then communicates via bore 23 with clearance 47 formed between bore 44 and the outer surface of housing 18 and O-rings 34 and 35. The carbonated water in cavity 47 also communicates with bore 9 and cavity 101 associated with soda diffuser 13. With this path provided, the carbonated water previously supplied to cavity 22 is no longer supplied from the source and, in fact, tends to bleed off to atmosphere via the above described path through nozzle 15. When the carbonated water bleeds out of cavity 22, the carbonated water supplied by port 2 applied pressure against diaphragm 7. This pressure tends to move diaphragm 7 to the right as suggested in FIG. 5B. When diaphragm 7 moves to the right, valve stem 8 is also moved integrally therewith. As a consequence, O-ring 41 no longer seals cavity 24 wherein carbonated water now passes through port 2, through cavity 24 into cavity area 16 and thence through port 10 into clearance 101. At this juncture, carbonated water is free to flow through clearance 101 and then through the clearances between soda diffuser 13, equalizer cup 14 and thence into nozzle 15.

Concurrently O-ring 40 is moved to the right with valve stem 8 and, thereby opens port 27 to receive syrup via bore 3. This syrup then passes down through bore 28 in stem 11 and out through apertures 12A in cap 12. The syrup mixes with the carbonated water in dispensing nozzle 15 and produces a carbonated drink.

When the appropriate drink has been dispensed, the receptacle such as glass or cup is removed and lever arm 4 returns to the right to its original (off) position. At this point, soda pressure on top of stem 5 returns valve stem 5 to the lower or down position as shown in solid line in FIG. 4. With this condition, the first mentioned carbonated water loop is restored wherein carbonated water is supplied via bore 6 to cavity 22 to return diaphragm 7 to the original position as suggested in FIG. 5A. Consequently, the drink is no longer dispensed through nozzle 15.

Referring now to FIG. 6, there is shown a front view of the dispenser of the instant invention. This front view is partially in section and partially in phantom. In the embodiment shown in FIG. 6, cap 45 has been removed for convenience. Consequently, the relationship of diaphragm 7 relative to the remainder of the dispenser is readily discernible.

Body 1 is shown, in FIG. 6, to be cylindrical in configuration. However, any suitable configuration is included in this description. Nozzle 15 depends from valve body 1 to form a drink dispensing nozzle. Nozzle 15 is mounted to the upper end of diffuser 13 which is inserted into cavity 100 in valve body 1. As shown elsewhere, nozzle 15 may be retained to diffuser 13 by means of suitable O-rings. Diffuser 13 is inserted over stem 11 which is mounted in communication with bore 27 in valve body 1. Stem 11 is firmly affixed to the valve body. Pressure equalizing cup 14 is mounted over diffuser 13 and in this combined configuration forms a pressure equalizing means. This pressure equalizing means is maintained in place by cap 12. Thus apertures 12A in cap 12 communicate with bore 28 in stem 11. Bore 28 in stem 11 communicates with bore 27 and bore 3 in valve body 1. As described supra, bore 3 is connected to the syrup source (not shown in this Figure). Metering screw 19 is mounted in bore 104 which communicates with bore 3 in order to control the flow of syrup into the dispenser. As described supra, when diaphragm 7 is flexed as a result of the pressure differential created by the carbonated water in response to actuation of lever 4 (not shown in this Figure) diaphragm 7 moves outwardly thereby moving stem portion 8A and thus, valve stem 8. Bore 27 is selectively opened for syrup to flow therethrough from bore 3. The syrup is supplied to the nozzle via bore 28 and apertures 12A in cup 12. The carbonated water is supplied via bore 10, clearance 101, and the clearances between stem 11 and soda diffuser 13 as well as the clearances between pressure equalizer cup 14 and both soda diffuser 13 and nozzle 15. The syrup is intermixed with the carbonated water to provide the desired drink.

Referring now to FIG. 7, there is shown a side view of the instant dispenser in exploded form. In addition, certain portions of the structure is shown in section and/or in phantom for ease in understanding. Thus, there is shown valve body 1 which, in some applications, may be made of an acrylic plastic, stainless steel or the like. Carbonated water port 2 extends substantially through valve body 1 and communicates with cavity 24 at the front end thereof. Cavity 24 has a substantially stepped configuration for receiving valve stem 8 therein. Port 6 communicates with bore 44 as well as cavity 24. Bore 21 communicates from bore 2 to bore 44A. Bore 9 communicates from bore 44 to cavity 101. Bore 3 (shown best in FIG. 3) communicates with cavity 27 and the end surface of valve body 1. Bore 10 communicates between cavity 101 and cavity 24. All of these arrangements are previously described. A detailed description thereof is believed unnecessary at this point.

Metering screw 31 includes a notched end thereof for receiving a screw turning apparatus, such as a screw driver or the like. Screw 31 includes a threaded portion which mates with threaded portion of bore 102, which communicates with bore 2. In addition, screw 31 includes groove 32A adjacent the inner end thereof for receiving O-ring 32 which forms a liquid tight seal with bore 102.

Valve stem 5 includes grooves 42A and 36A for receiving O-rings 42 and 36, respectively. Valve stem 5 also includes a notched portion 5A which is engaged by the shorter arm 4A of lever arm 4. Valve stem 5 is inserted into a central opening 18A of housing 18 which includes bore 23 which communicates with the central opening 18A (FIG. 4). Housing 18 includes grooves 34A and 35A adjacent the opposite ends thereof for receiving O-rings 34 and 35, respectively. O-rings 34 and 35 provide liquid tight seals with the periphary of bore 44.

End cap 45 includes groove 30A for receiving O-ring 30 to provide a liquid tight seal with the outer edges of cavity 24. The inner surface cap 45 is depressed to form cavity 22. Openings 43 permit communication between cavity 22 and clearance 103 (FIG. 5A) between cap 45 and the surface of cavity 24.

Valve stem 8 includes an enlarged end portion 8A and groove 7A adjacent thereto for receiving diaphragm 7. An enlarged portion of valve stem 8 abuts against diaphragm 7 to maintain the diaphragm in the appropriate location relative to valve stem 8. At a smaller middle portion of valve stem 8, there are provided grooves 25A and 41A for receiving O-rings 25 and 41, respectively. At the inner end of valve stem 8, which has a diminished diameter relative to the mid-section, there is provided groove 40A for receiving O-ring 40. The assembly comprising valve stem 8 and the associated O-rings and diaphragm 7 is inserted into cavity 24 in valve body 1. Cap 45 and the associated O-ring are placed in cavity 24 behind valve stem 8 to maintain the valve stem in the general position but free to flex as described supra.

Syrup stem 11 includes a hollow bore 28 which has a threaded portion 28A at the outer end thereof. The inner end (unthreaded) fits snugly into the inner poriton of stepped cavity 100. Thus, bore 28 of valve stem 11 communicates with bore 27 of valve body 1.

Diffuser 13 is an essentially T-shaped structure. A central bore 13A is provided therein for receiving syrup stem 11. The inner end of diffuser 13 includes cavity 101, which communicates with bores 9 and 10 as described supra. The inner or larger end of diffuser 13 includes grooves 38A and 39A for receiving O-rings 38-39, respectively. At the outer or smaller end thereof diffuser 13 includes apertures 13B which communicate with the inner bore or cavity formed in U-shaped equalizer cup 14. Cup 14 is adapted to fit over the smaller and of diffuser 13 but to provide clearance between the walls thereof. In addition, equalizer cup 14 includes a central aperture 14A at the bottom thereof for receiving the threaded portion of end cap 12 therethrough. End cap 12 includes a threaded portion which mates with threaded portion 28 A of syrup stem 11. In addition, end cap 12 includes a central bore which communicates with apertures 12A and bore 28 of stem 11. The final mixing nozzle 15 has a tapered portion which encompasses cup 14, equalizer 13 and stem 11. The upper portion of nozzle 15 is dimensioned so as to form a force-fit with O-ring 39 on diffuser 13.

Thus, there is shown and described a perferred embodiment of the instant invention. This invention is directed to an improved post-mix soft drink dispenser. With the apparatus as described hereinabove higher carbonation and faster drink flow, for example at least ½ ounce per second greater than prior art devices is provided. The dispenser description hereinabove is intended to be illustrative and not limitative. Those skilled in the art may concieve various modifications which can be made to the dispenser. However, any such modifications which fall with the purview of this description are intended to be included therein as well. The scope of the invention is intended to be defined only by the claims appended hereto and equivalents.

Having thus described a preferred embodiment of the invention, what is claimed is:

1. A dispenser comprising;

a body, first and second valves in said body, first bore means for applying a first fluid to each of said valves to established pressure thereat to maintain said first and second valves in a first position, means for moving said first valve to a second position against the pressure established by said fluid, second bore means communicating between said first and second valve only when said first valve is in said second position to relieve the pressure established at said second valve wherein said second valve moves to a second position, nozzle means, third bore means for applying a second fluid to said nozzle means only when said second valve is in said second position, and fourth bore means communicating between said second valve and said nozzle means only when said second valve is in said second position wherein said first and second fluids are mixed together in said nozzle means.

2. The dispenser recited in claim 1 wherein;

said second valve includes diaphragm means for receiving said first fluid on opposed sides thereof to establish a pressure condition such that said second valve assumes said first position.

3. The dispenser recited in claim 2 wherein;

said diaphragm flexes when said first valve assumes said second position as a result of the change in pressure on the opposed sides thereof whereby said second valve assumes said second position.

4. The dispenser recited in claim 1 wherein;

said nozzle means includes a syrup stem for dispensing said second fluid, cap means attached to said syrup stem for dispensing said second fluid into said nozzle means.

pressure equalizer means for receiving and dispensing said first fluid at a uniformly distributed pressure.

5. The dispenser recited in claim 4 wherein;

said pressure equalizer means includes clearance at the inner end thereof adjacent said body such that said clearance communicates with said second bore means to provide a path to relieve the pressure at said second valve.

6. The dispenser recited in claim 5 wherein;

said pressure equalizer includes seal means for forming a force fit with said body.

7. The dispenser recited in claim 6 wherein;

said pressure equalizer includes seal means for forming a force fit with said nozzle means.

8. The dispenser recited in claim 1 wherein;

said first valve comprises valve stem means connected to said means for moving, seal means at one end of said valve stem means to seal said second bore means to prevent said first fluid from reaching said second valve.

9. The dispenser recited in claim 1 wherein;

said second valve includes a second valve stem, seal means at one end of said second valve stem for sealing said third bore means to prevent said second fluid from being applied to said nozzle means.

10. The dispenser recited in claim 1 wherein;

said second valve includes further seal means on said second valve stem to form fluid tight openings relative to said second bore.

11. The dispenser recited in claim 1 including;

constricter means for controlling the flow of said first and second fluids through said first and third bore means.

12. The dispenser recited in claim 11 wherein;

said constricter means comprise threshold means for adjustable positioning in said first and third bore means.

13. The dispenser recited in claim 1 including;

cap means attached to one end of said body means, said cap means including a cavity at the inner surface thereof to receive said second valve.

14. The dispenser recited in claim 1 wherein;

said body is fabricated of acrylic.

15. The dispenser recited in claim 1 wherein;

said means for moving includes lever means to be moved by an operator of said dispenser.

* * * * *